United States Patent [19]

Bostelmann

[11] 4,365,953

[45] Dec. 28, 1982

[54] COOLER FOR COMBUSTIBLE MATERIAL

[75] Inventor: Jürgen Bostelmann, Rosengarten, Fed. Rep. of Germany

[73] Assignee: Claudius Peters AG, Fed. Rep. of Germany

[21] Appl. No.: 169,276

[22] Filed: Jul. 16, 1980

[30] Foreign Application Priority Data

Jul. 17, 1979 [DE] Fed. Rep. of Germany ..... 2928752

[51] Int. Cl.[3] ..... F27D 15/02

[52] U.S. Cl. ..... 432/78; 34/86; 122/27; 432/79

[58] Field of Search ..... 432/78, 79, 80, 83; 122/27, DIG. 1; 34/86

[56] References Cited

U.S. PATENT DOCUMENTS

| | | | |
|---|---|---|---|
| 1,624,602 | 4/1927 | Jacobus et al. | 122/27 |
| 2,055,385 | 9/1936 | Noack | 122/DIG. 1 |
| 2,404,938 | 7/1946 | Armacost et al. | 122/DIG. 1 |
| 2,471,755 | 5/1949 | Karrer | 122/DIG. 1 |

*Primary Examiner*—Albert W. Davis, Jr.
*Attorney, Agent, or Firm*—Eric P. Schellin

[57] ABSTRACT

A cooler for combustible material has a first section of cooling grate which is traversed by a cooling air that is fed completely to a burner as air for combustion, and has a further section likewise traversed by cooling air under the effect of at least one ventilator or blower wherein the ventilator is driven directly by a steam turbine, and that with the second section or another further section of the cooler, a steam generator is connected with the turbine.

6 Claims, 2 Drawing Figures

COOLER FOR COMBUSTIBLE MATERIAL

BACKGROUND OF THE INVENTION

1. Field of the Invention

The invention relates to a cooler for combustible material, which in a first section is traversed by cooling air to be fed completely to the burner as air for combustion, and has a further section likewise traversed by cooling air under the effect of at least one blower or ventilator.

2. Prior Art

In a known cooler type, as seen in the Germany petty patent ("Gebrauchsmuster") No. 1,985,673, issued to the firm of Polysius G.m.b.H., of Neubechum, an air-traversed water screen is divided into two sections. The cooling air flowing through the first section is fed to the calcining furnace as additional air for combustion, while the cooling air of the second section is passed as exhaust air over the roof. A waste heat utilization of the exhaust air of the second cooler section is profitable generally only when the exhaust heat can be utilized directly, e.g., for a warming-up or drying of the material to be fed to the burner. It cannot be used for current generation since with the relatively low exhaust air temperatures and the expense necessary for its dust removal, the efficiency is too low and thereby the energy cost becomes too high. This applies also to another known cooler type, as disclosed by Kayatz in U.S. Pat. No. 3,705,620, which provides an indirect cooling in the second stage. In such a case, to be sure, the expense for the dust removal from the cooling air is eliminated. However, with indirect cooling air, the cooling air is of a lower temperature, which decreases further the efficiency of a transformation of energy.

SUMMARY OF THE INVENTION

The purpose of the invention is, therefore, to provide an apparatus which utilizes the waste heat of the cooling air not fed to the burner as additional air, in cases where this cooling air is not directly utilized for the warming-up or drying of the material to be fed to the burner.

The solution offered by the invention consists in that the ventilator or blower of a further cooling stage is driven directly by a steam turbine and that this turbine is driven by the steam of a steam generator connected with this section or another further section of the cooler.

It is known that the exhaust heat contained in cooling air can be utilized by using it to heat or assist in heating steam for the operation of a steam turbine. With this idea, however, the invention is not made obvious, since important viewpoints and characteristics, resulting from the particular utilization connection, must in addition be considered.

For instance, the calcining furnace and the cooler associated therewith react very sensitively to changes in the working conditions. The sudden breakdown of a drive or even just the change of a drive speed may cause not only serious changes in production quality but also damages to the furnace and cooler. Great care is therefore applied in the planning to the safety of the furnace and cooler operation. Therefore, in the drives, energy sources are employed that are generally not, or only in exceptional cases, threatened by variations or breakdown, namely generally the public electricity line. A turbine driven by the exhaust heat of the cooler is, on the other hand, subject principally to strong power variations. This applies not only to the starting-up and closing-down of the furnace and the cooler, but also for operation-connected cooler irregularities, as they, e.g., occur when suddenly an unusually large amount of material passes from the furnace into the cooler and thereby an unusually great cooling capacity is available or when a stoppage in the material flow occurs and thereby the cooling power decreases. It has therefore never been seriously considered to utilize the exhaust heat power of the cooler for the drive of cooler or furnace elements. In contrast thereto, the invention is based on the knowledge that the negative consequences of a variable power supply on the turbine of the invention are not critical; when the turbine is used for driving the blower or ventilator of a cooler section following the first, hot cooling section, namely, preferably of a cooling section connected in series so as to follow the cooling section with which the steam generator for the turbine is associated.

Furthermore, it is in this operation relevant that the turbine effects not just any cooler drive (e.g., the thrust) but the drive of a cooling air blower or ventilator. The reason for this is that if one considers the case where suddenly the cooling section associated with the steam generator is provided with an unusually large amount of material, the power of the turbine also rises and thus the power of the ventilator for the cooling of this unusually large amount of material. When, inversely, the material supply slackens and thereby the power of the steam generator and the turbine is reduced, less cooling air is needed.

Finally, it is for the invention also relevant that the coupling of the turbine with a cooler ventilator renders, due to the spatial proximity of the units with which these parts are associated, a costly conveyance of energy, cooling air or steam superfluous, and that therefore also an energy transformation into electric current is not necessary. The invention is based on the discovery that the conditions in a cooler for combustible material therefore offer an ideal situation for a direct drive of a ventilator by the turbine.

When the cooler is of a structural type wherein the first cooling section is followed by a second cooling section in which the material is directly traversed by the cooling air, it is according to the invention provided that this second cooling section is traversed in a closed cycle with the steam generator by the cooling air. This entails the great advantage that not only the waste heat of the second cooling section is usefully employed, but also that the dusty cooling air need not be discharged but can with its dust content included, be re-fed to the cooling section. In the cooling air cycle, a dust remover may be inserted in front of the steam generator. In many cases, however, this might not even be necessary since a certain dust content of the gas rather improves the heat transfer in the steam generator, and the steam generator can easily be constructed in such a manner (e.g., as a fire-tube boiler in vertical construction) that a dust deposit on the heat transfer surfaces does not take place. In this structure, the invention presents not only the advantage of the heat utilization but also of avoidance of arrangements for the dust removal from the waste air of the second cooling section.

The turbine may drive the ventilator of the same cooler section. Preferably, however, it may now drive the ventilator of a following third cooling section.

When the cooler is of the type wherein the first cooling section is followed by a second, indirect cooling section, the invention provides that as the cooling medium in the said second cooling section, water is used whose steam is fed to the turbine. The turbine then drives the ventilator of a third, generally likewise indirect cooling section.

It is suitable to provide for the cooling section whose ventilator is driven by the turbine an emergency cooling device for the case of a drive breakdown. This emergency cooling device need not have a power comparable to that of the ventilator, since it needs to bring about a gradual cooling of the material only when the cooler for any reasons (e.g. on account of any damage to the furnace) must suddenly be shut down. In such cases there is enough time for cooling off the cooler portion concerned, so that the cooling power of the emergency cooling device needs to supply only a small fraction of the normal cooling power. It therefore does not increase the necessary manufacturing expense. It suffices therefore when it is based simply on a natural draft in a chimney of limited height.

BRIEF DESCRIPTION OF THE DRAWINGS

The invention is explained in greater detail in the accompanying drawings, wherein.

DETAILED DESCRIPTION OF THE PREFERRED EMBODIMENTS

Figure 1:
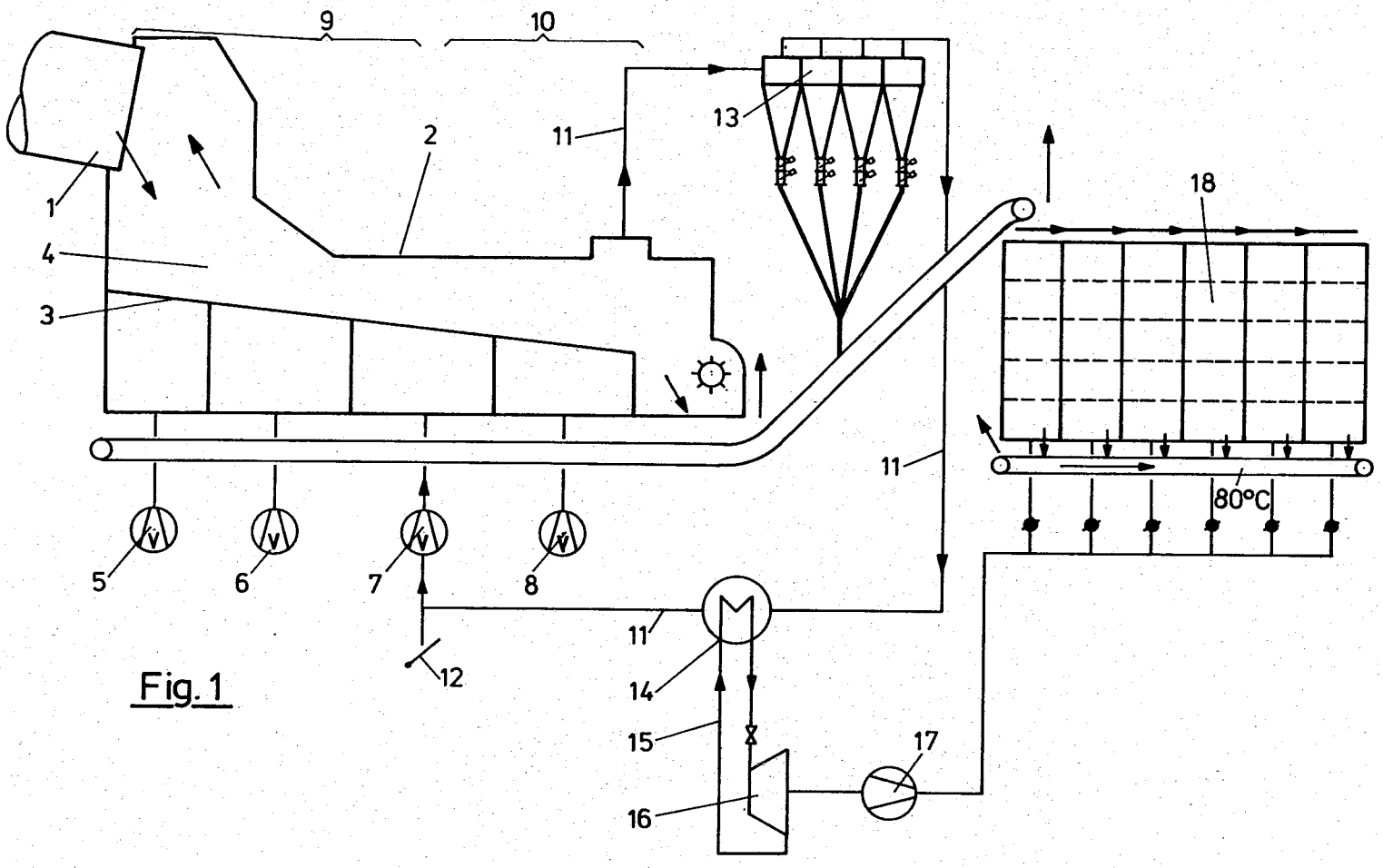
FIG. 1 is a diagrammatic side view of a first embodiment.

According to FIG. 1, a rotary kiln 1 feeds the hot combustible material to a cooler 2 which is equipped with an inclined step grate 3 within a closed cooling chamber 4. Grate 3 is supplied with cooling air from the bottom sectionwise by ventilators 5–8. The cooling air within a first cooling section 9, whose length is unrelated to the length of the grate sections supplied by the individual ventilators, is fed to the kiln as additional air. The cooling air of the second cooling section 10 is passed through a pipe line 11 via ventilator 7 in a loop or cycle. It may happen that a portion of the cooling air fed through ventilator 7 to the cooler enters also the kiln, while the fresh air aspirated by ventilator 8 enters predominantly the loop or cycle; this, however, is irrelevant for the concept of the cycle. Instead of ventilator 7 or in addition thereto, ventilator 8 could be connected with pipe line 11. Pipe line 11 could also be connected with a ventilator located nearer to the front in the cooling path. A regulation of the supplied amount of cooling air is possible due to a fresh air flap 12.

In the cycle of cooling air line 11, a dust remover 13 is provided whose discharged material is re-fed to the material to be cooled, and a steam generator 14, connected via a pipe line 15 to a turbine 16. The latter drives directly a ventilator 17 belonging to a third cooling section 18, which in the manner described in the U.S. Pat. No. 3,705,620 is connected in series so as to follow the direct grate cooler, as an indirect cooler.

The exhaust steam from turbine 16 is condensed in condenser 16*a* and the condensate is pumped by feed pump 29*b* back to the pipe coil 25, to complete a closed loop, in accordance with conventional practice.

Figure 2:
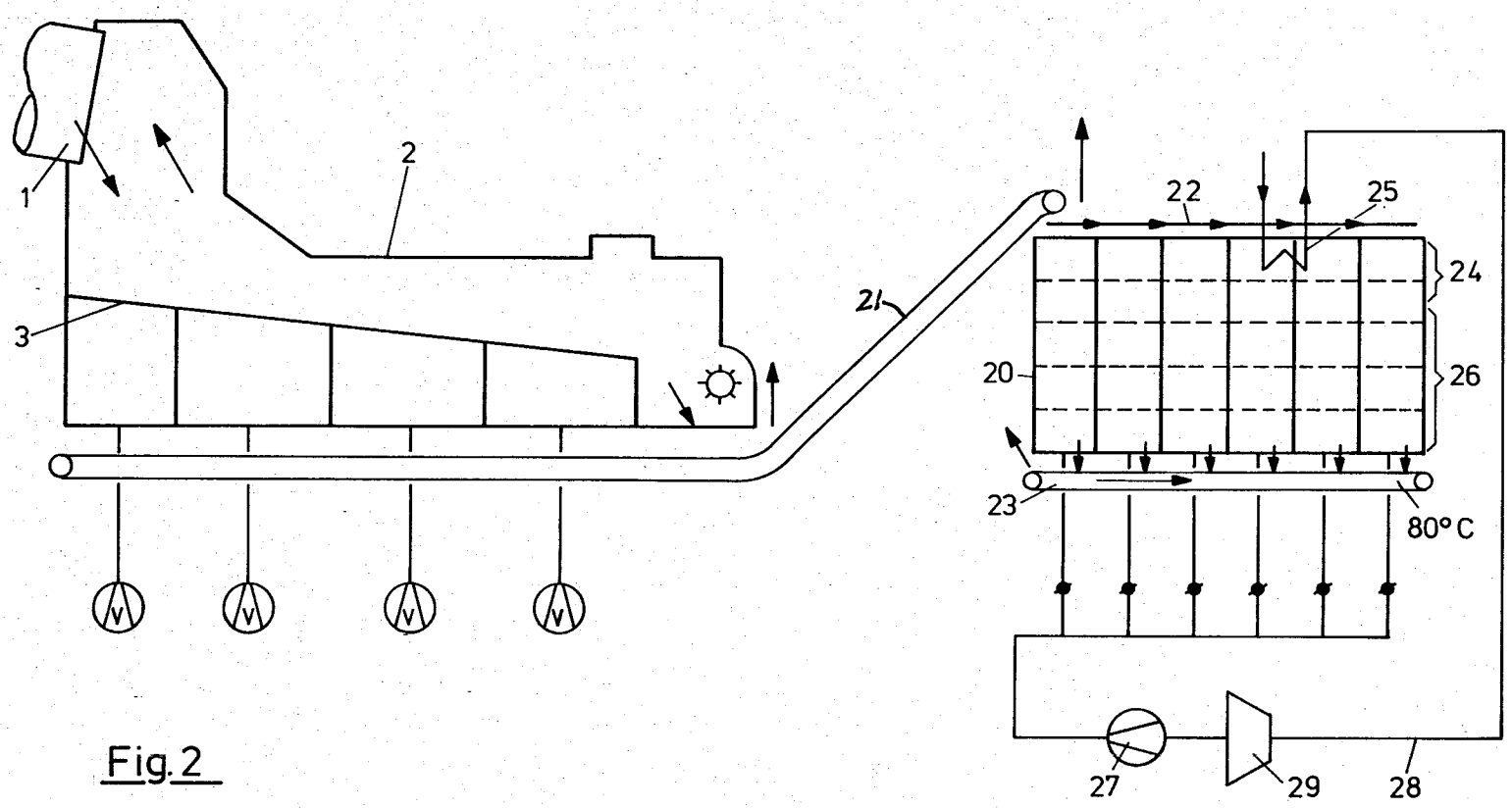
FIG. 2 is a diagrammatic side view of a second embodiment.

In the cooler embodiment of FIG. 2, the direct cooler 2 is designed in such a way that its entire cooling air can be fed to kiln 1. The material to be cooled is then fed to an individual cooler 20 to which the material is uniformly delivered on the top by a conveyor 21 and a chute 22. Through a multiplicity of shafts bordered by cooling surfaces it then sinks downward in order to be pulled off by a belt 23. The cooling surfaces in an upper section 24 of cooler 20 are cooled by water, as indicated by the symbol of a pipe coil 25, while the cooling surfaces in the lower section 26 of cooler 20 are cooled by atmospheric air which is conveyed by a ventilator 27. In the coil pipes 25 of cooling section 24 steam is generated which is fed, through a pipe line 28, shown for the sake of simplicity only by single line, to a turbine 29 which thus drives directly ventilator 27. The exhaust steam from turbine 29 is condensed in condenser 29*a* and the condensate is pumped by feed pump 29*b* back to the pipe coil 25, to complete a closed loop, in accordance with conventional practice.

In this embodiment too, therefore three cooling sections can be distinguished, namely, a first cooling section formed by direct grate cooler 2, a second cooling section formed by water-cooled section 24 of cooler 20, and a third section whose ventilator is driven by the waste heat of the second cooling section and which is formed by the air-cooled part 26 of cooler 20.

What we claim as new and desire to secure by United States Letters Patent is:

1. A cooler for combustible material, comprising:

a cooling grate divided into sections;

first cooling air circulating means connected with the grate sections to circulate cooling air therethrough to cool the material;

means associated with a first section to feed completely the cooling air circulated through that section to a burner as air for combustion;

second cooling air circulating means associated with a further section to circulate cooling air through the further section;

said second cooling air circulating means including a blower;

a turbine connected with the blower to drive the blower; and a steam generator associated with the further cooling section to utilize the waste heat of the cooling air circulated through the further cooling section, to generate the steam used to drive the turbine.

2. A cooler as in claim 1, wherein:

cooling air circulating means connected with a second cooling section following the first cooling section causes the cooling air to flow directly through the material in a closed cycle through a boiler for steam generation.

3. A cooler as in claim 2, wherein:

the second cooling section is followed by a third cooling section whose blower is directly driven by the turbine.

4. A cooler as in claim 1, wherein:

the first cooling section is followed by a second, indirect cooling section, wherein as a cooling medium, water is used from which steam is generated and fed to the turbine; and the blower of a third cooling section is directly driven by the turbine.

5. A cooler as in claim 1, 2, 3 or 4, wherein:

an emergency cooling device is provided for the cooling section whose blower is driven directly by the turbine.

6. A cooler as in claim 5, wherein:

the emergency cooling device is based on natural draft and is designed for a substantially lower cooling speed than the one prevailing in normal operation.

* * * * *